United States Patent [19]

Ekstrand

[11] Patent Number: 4,603,826

[45] Date of Patent: Aug. 5, 1986

[54] MEANS FOR ADJUSTING A SIGHTING INSTRUMENT IN RELATION TO A SUPPORT

[76] Inventor: John A. I. Ekstrand, Utteröd 1, S-240 33 Löberöd, Sweden

[21] Appl. No.: 608,245

[22] Filed: May 8, 1984

[51] Int. Cl.[4] ..... A47B 96/06

[52] U.S. Cl. ..... 248/205.1; 248/178

[58] Field of Search ..... 248/178, 205.1, 201; 42/1 ST; 33/247, 248, 250

[56] References Cited

U.S. PATENT DOCUMENTS

| | | | |
|---|---|---|---|
| 374,202 | 12/1887 | Rice | 33/247 |
| 2,237,395 | 4/1941 | Sweet | 42/1 ST X |
| 2,607,120 | 8/1952 | Williams | 248/201 X |
| 2,783,539 | 3/1957 | Dahlberg | 33/248 |
| 3,406,455 | 10/1968 | Akin | 248/205.1 X |
| 3,419,334 | 12/1968 | Hubbard | 33/247 X |
| 4,409,738 | 10/1983 | Renander | 33/248 X |

FOREIGN PATENT DOCUMENTS

| | | | |
|---|---|---|---|
| 2137659 | 2/1973 | Fed. Rep. of Germany | 33/248 |

*Primary Examiner*—J. Franklin Foss

*Attorney, Agent, or Firm*—Shapiro and Shapiro

[57] ABSTRACT

An adjustment means for adjusting a sighting instrument in relation to a supporting means comprises a pair of supporting members supporting said sighting instrument at longitudinally spaced supporting points, and adjustable connecting means connecting each of the supporting members to the supporting means. A respective resilient biasing means exerts an elastic force between each supporting member and the supporting means and forms an elastic spacer between the corresponding supporting member and the supporting means. Each connecting means comprises adjustable and spring compression screw means for compression of the corresponding elastic spacer and thereby adjusting the angle between the longitudinal axis of the sighting instrument and a selected plane which is fixed in relation to the supporting means.

1 Claim, 2 Drawing Figures

MEANS FOR ADJUSTING A SIGHTING INSTRUMENT IN RELATION TO A SUPPORT

This invention relates to adjustment means for adjusting a sighting instrument in relation to a support.

In many cases where a sighting instrument is mounted on a mobile support, such as a bow or other projectile weapon, it is desired to be able to make corrections of the instrument with respect to the support, for example in order to compensate for different distances between the instrument and the target.

Several adjustment means serving such purposes are known, but nevertheless improvements aiming at simplicity of construction, a moderate price, general usability and durability are desired for many special applications.

Therefore, according to the invention, there is realized an improved adjustment means for adjusting a sighting instrument in relation to a supporting means, said adjustment means comprising a pair of supporting members for supporting said sighting instrument at longitudinally spaced apart supporting points, adjustable connecting means for connecting each of said supporting members to said supporting means in spaced apart relation therewith, and resilient biasing means for exerting an elastic force between said supporting means and at least one of said supporting members, said resilient biasing means being mounted to form a compressible elastic spacer between said one supporting member and said supporting means, said connecting means for connecting said one supporting member to said supporting means including adjustable compression screw means for adjusting the degree of compression of said elastic spacer and thereby adjusting the angle between the longitudinal axis of the sighting instrument and a selected plane which is fixed in relation to said supporting means.

Figure 1:
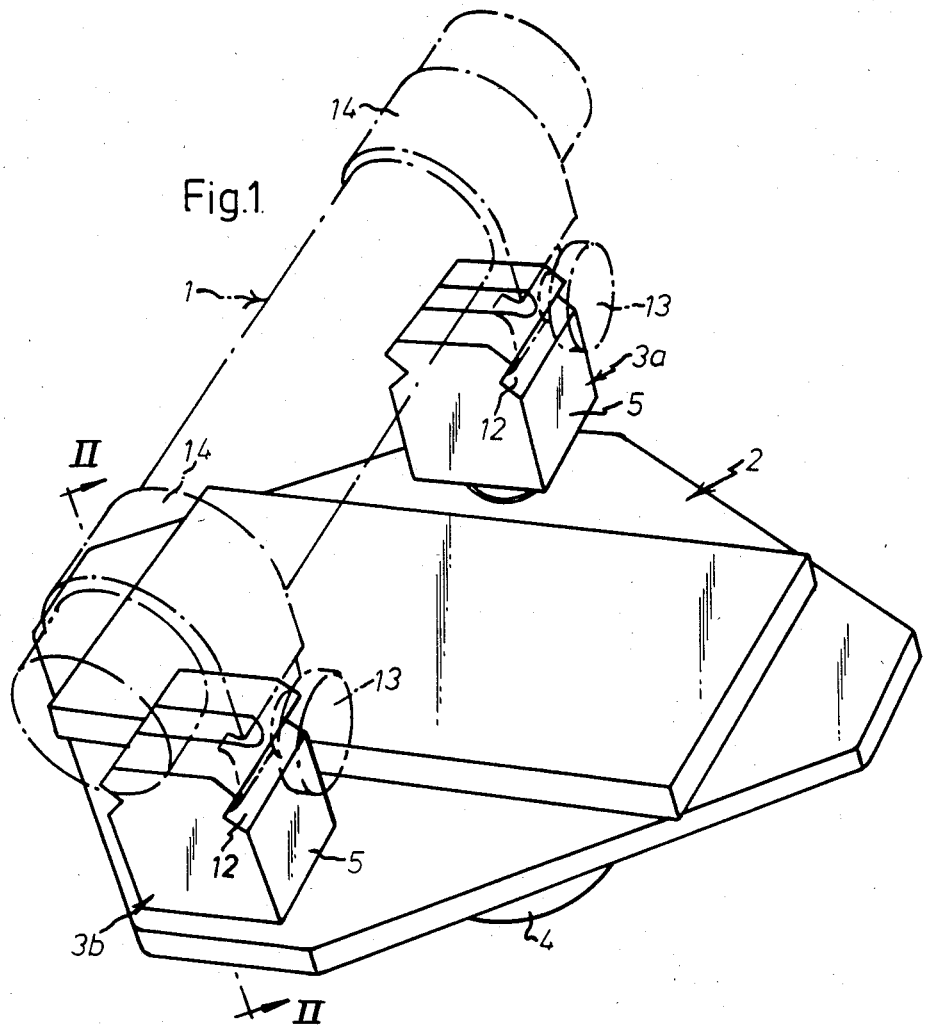
Figure 2:
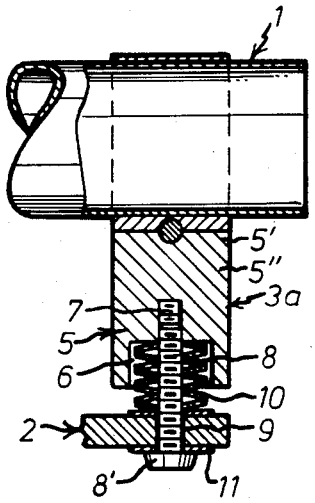

The invention will be explained in more detail in the following description of a preferred embodiment thereof, reference being made to the accompanying drawings in which FIG. 1 is a perspective view showing a pair of adjusting means according to the invention associated with a supporting plate and a sighting instrument which is shown in phantom view;

FIG. 2 is one of the adjustment means in cross-section along lines II—II in FIG. 1.

FIG. 1 shows a sighting instrument 1 in phantom view, adjustably mounted on a supporting plate 2 by means of a pair of adjustment means 3*a*, 3*b* according to the invention. These adjustment means 3*a*, 3*b* are identical to each other.

As an example, the supporting plate shown in the drawings may be intended to be fixed to a mobile support, such as a bow used for archery, and the sighting instrument may be a light-weight, known optical sighting tube of the light-spot type and of simple construction and, possibly, without any adjusting mechanism of its own. The supporting plate 2 may be arranged for adjustable attachment to the bow by an adjusting system, a fragmental part of which is shown and designated by reference number 4 in FIG. 1.

Each adjusting means 3*a*, 3*b* comprises a block 5 in which an open-ended cylindrical chamber 6 is formed, the inner end of which is closed by a head portion 5' of the block 5. In this head portion 5' a threaded bore 7 is formed which extends into the head portion 5' from the bottom of the chamber 6 and receives an end portion of a screw 8 which extends from the opposite side of the plate 2 in relation to the position of the sighting instrument, through a bore 9 in the plate 2 and through the chamber 6 into the threaded bore 7. The chamber 6 and the threaded bore 7 are coaxial in relation to each other, and of course the block 5 is positioned such that the threaded bore 7 is in alignment with the bore 9 in the plate 2.

The chamber 6 houses a resilient biasing means shown in the form of an assemblage 10 of cup-shaped spring washers surrounding the screw shank. This assemblage 10 rests against the bottom of the chamber 6 and extends out through the open end of the chamber into contact with the facing side of the plate 2. By rotating the screw 8, the head 8' of which rests on the opposite side of the plate via a washer 11, the spring assemblage 10 is compressible to any desired extent between the block 5 and the plate 2.

The block 5 is constructed such that it can be said to be a modification of the foot of the well-known and conventional Weaver-type mounting for optical rifle sighting tubes. More particularly, as shown in FIG. 1, longitudinal guiding and engagement grooves 12 for the conventional Weaver clamps (not shown) are formed at opposite sides of the head portion 5'. By means of such Weaver clamps and conventional clamp screws 13 according to the Weaver mounting system, conventional Weaver straps 14 surrounding the sighting tube 1 may be clamped to the Weaver foot, that is to the head portion 5' of the block 5, as shown in FIG. 1.

The adjusting means according to the invention permit a simple but, for many purposes, sufficient adjustment of the sighting tube 1 in the following manner.

With the plate 2 supporting the sighting tube 1 and attached to or constituting part of a rifle, a firearm or a bow as mentioned above, test shooting may be carried out.

Should such test shooting show that the sighting tube 1 is incorrectly adjusted, such as incorrectly ranged in elevation or azimuth, as the case may be, one or both of the adjusting screws of the adjustment means 3*a*, 3*b* are rotated through one or more full turns, or through but a fraction of a turn, according to the incorrect adjustment observed. In this manner, the angle between the longitudinal axis of the sighting tube 1 and a line between the supporting points or spots for the outer ends of the spring assemblages 10 may easily be adjusted by means of one or both of the adjusting screws 8. Therefore, any desired inclination of the sighting tube 1 in relation to a support, such as the supporting plate 2 shown, a part of a weapon, etc., can be realized within the limits of the space between each block 5 and the support 2. It is pointed out that a small inclination of the screws 8, possibly in combination with a minor deflection thereof which is permitted by a clearance existing between the periphery of the spring assemblages and the walls defining the periphery of the chambers 6, will result in a relatively great inclination of the sighting tube in relation to the support 2.

It is understood that the embodiment of the adjusting means shown in FIG. 2 represents a preferred example only and that modifications, especially in respect of the relationship between the longitudinal and circumferential dimensions of the block 5 and the spring assemblages 10, are possible within the scope of the invention, and that furthermore, use may be made of a resilient biasing means different from the illustrated spring washer assemblages.

What I claim and desire to secure by Letters Patent is:

1. Adjustable mounting apparatus for adjusting a sighting instrument in relation to a support means, said apparatus comprising a pair of hollow support blocks for supporting said sighting instrument at two longitudinally spaced points, each supporting block having groove means at opposite sides thereof for cooperation with a clamping device for securing said sighting instrument to said block, each block also having a chamber with an open end disposed so as to face said support means, and further having associated means for connecting said block to said support means in adjustable spaced relation to said support means, said associated connecting means including compressible spring means mounted within said chamber and projecting through said open end thereof for resiliently supporting said block in spaced relation to said support means, and adjustable compression screw means for adjusting the degree of compression of said spring means, said screw means extending from said support means into a threaded bore which extends into said block from the base of said chamber, said screw means being threadably received in said bore and said spring means constituting an elastic spacer between said support block and said support means, whereby adjustment of said screw means effects a change in the angle between the longitudinal axis of said sighting instrument and a selected plane fixed relative to said support means.

* * * * *